United States Patent [19]

Vecchio et al.

[11] Patent Number: 4,618,415

[45] Date of Patent: Oct. 21, 1986

[54] TOBACCO SEPARATOR

[75] Inventors: Anthony J. Vecchio; John H. Hudson, Jr., both of Richmond, Va.

[73] Assignee: AMF Incorporated, White Plains, N.Y.

[21] Appl. No.: 646,657

[22] Filed: Aug. 31, 1984

[51] Int. Cl.[4] ..... B07B 4/02; B02C 23/10

[52] U.S. Cl. ..... 209/134; 209/3; 209/154; 131/313; 131/319; 131/109.2; 241/79.1

[58] Field of Search ..... 209/134, 135, 137, 136, 209/142, 3, 133, 3, 154; 131/109 B, 313, 319, 320; 130/31 R, 30 R, 27 R; 241/79.1, 19; 56/14.6

[56] References Cited

U.S. PATENT DOCUMENTS

| | | | |
|---|---|---|---|
| 2,210,103 | 8/1940 | Stoner | 209/135 |
| 2,222,861 | 7/1936 | Stoner | 209/135 |
| 3,034,646 | 3/1962 | Elssmann et al. | 209/133 |
| 3,164,548 | 1/1965 | Rowell | 209/139.1 |
| 3,265,209 | 8/1966 | Wochnowski et al. | 209/136 |
| 3,593,851 | 7/1971 | Davidson | 209/139.1 X |
| 3,856,217 | 12/1974 | Brewer | 241/79.1 X |
| 4,077,573 | 3/1978 | Kersoy et al. | 241/39 |
| 4,253,940 | 3/1981 | Price | 209/134 X |
| 4,418,871 | 12/1983 | Powell | 241/79.1 X |
| 4,465,194 | 8/1984 | Coleman | 209/142 X |

FOREIGN PATENT DOCUMENTS 713693 8/1954 United Kingdom .

*Primary Examiner*—S. Leon Bashore
*Assistant Examiner*—Thomas M. Lithgow
*Attorney, Agent, or Firm*—Finnegan, Henderson, Farabow, Garrett & Dunner

[57] ABSTRACT

A tobacco separator is provided for separating light fractions (laminae) from heavy fractions (mid-rib or stem) from threshed tobacco.

The separator comprises a separating chamber (10) having an upper first inlet (8) for receiving the material to be separated or classified, and a lower second inlet (9) for receiving a flow of air directed transversely of the material path from the first inlet, a plurality of channels (14–17) are disposed one above the other to receive the tobacco laden air from said inlet, a vertical air passage (20) in communication at its lower end with the lowermost of said channels; and an outlet passage (19) in communication with all said channels.

5 Claims, 1 Drawing Figure

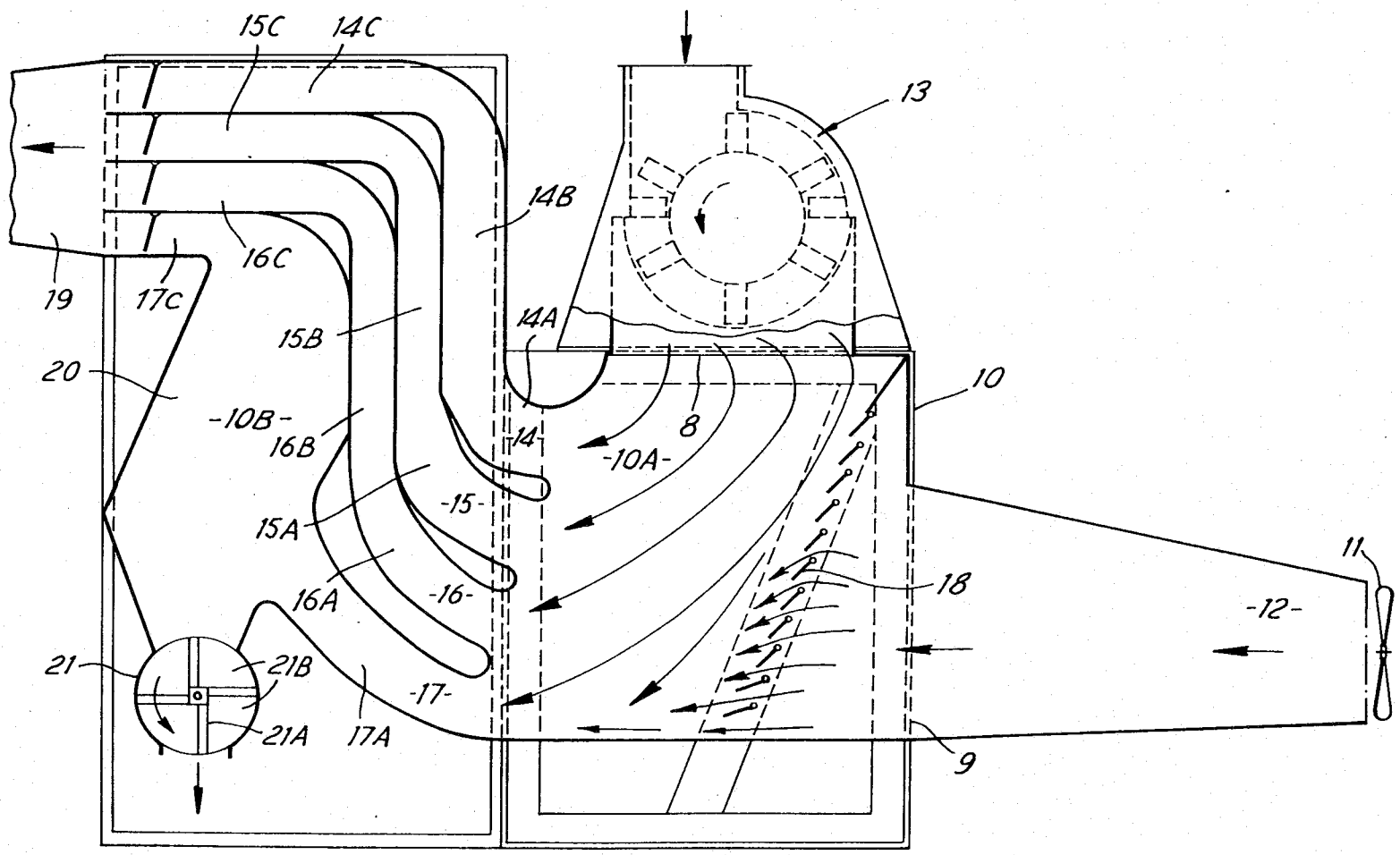
11
12
10
9
18
13
8
10A
14A
14
14B
15
16
17
17A
14C
15C
15B
16B
16A
15A
21B
21A
16C
10B
17C
20
21
19

TOBACCO SEPARATOR

BACKGROUND TO THE INVENTION

This invention relates to a separator for classifying or separating the laminae from the mid-rib or stem from threshed tobacco.

The complete threshing process comprises successive stages of threshing and separating. A typical threshing drum is described in our U.S. Pat. No. 4,077,573.

STATEMENT OF PRIOR ART

In the simplest form of known pneumatic separator, it comprises a 'tower' separator chamber having a vertical duct with an up draught. The output from the threshing drum is thrown horizontally into the duct near the bottom of the chamber, and the vertical up draught is adjusted to allow the heavy stems to descend to a take-off conveyor, and the lighter tobacco laminae to be conveyed upwards by the air flow. Such a separator is described by Rowell et al in U.S. Pat. No. 3,164,548.

The disadvantage of the above mentioned 'tower' separator is that there is some conflict between the light ascending particles and heavy descending particles, which reduces the efficiency.

An alternative design of a 'transverse' separator is shown in our U.S. Pat. No. 3,593,851 in which the air flow is horizontal across a chamber. The threshed products are thrown horizontally against the air flow into the top of the chamber by a winnower. The heavy stems are thrown to the far air inlet side of the chamber where they fall onto a take-off conveyor. The light laminae are thrown a lesser distance and are drawn back into the exhaust duct.

The disadvantage of the above mentioned 'transverse' air flow separator is that there is insufficient height to ensure that all the laminae are drawn off into the exhaust duct, so that several stages of separation are required to give efficient separation.

In a variant of the 'tower' type of separator the product is introduced by a fast conveyor, but there is a tendency for clumping of the product, which lowers efficiency.

The product is normally conveyed pneumatically between the stages of threshing and separating so that the tobacco has to be separated from the air before feeding into the next stage of thresher or separator.

A tangential separator is also known such as shown in UK Pat. No. 713,693 to Rowell.

A further disadvantage of existing separators is that the winnower with its high speed blades, causes degradation of the product. Also the unloader and its compartmented wheel of a tangential separator can cause degradation of the product.

Another disadvantage is that the take-off conveyor belt wears and has tracking problems.

OBJECT OF THE INVENTION

An object of the present invention is to overcome these disadvantages.

SUMMARY OF THE INVENTION

According to the invention there is provided a tobacco separator for separating light fractions from heavy fractions, comprising a separating chamber having an upper first inlet for receiving the material to be separated or classified, and a lower second inlet for receiving a flow of air directed transversely of the material path from the first inlet; a plurality of channels disposed one above the other to receive the tobacco laden air from said inlets, a vertical air passage in communication at its lower end with the lowermost of said channels, and an outlet passage in communication with said channels.

BRIEF DESCRIPTION OF DRAWINGS

The invention will now be described by way of example with reference to the accompanying drawing which shows a schematic sectional view of the separator.

DESCRIPTION OF PREFERRED EMBODIMENTS

In the present invention there is provided a separating chamber 10 having an inlet compartment 10A and an outlet compartment 10B. The inlet compartment 10A has a horizontal air flow entering inlet 9 from a fan 11 through a duct 12. A threshing drum 13 is mounted directly on top of the chamber 10 so that tobacco is thrown directly through an upper inlet 8 into the compartment 10A by the drum, thus eliminating the need for a separate winnower and unloader.

The inlet compartment 10A is higher compared with known apparatus so that four side openings 14–17 can be accommodated to remove the tobacco laden air. Air enters the chamber on the opposite side from the passages through a number of adjustable louvres 18 extending from the top to the bottom of the compartment 10A. The three uppermost openings 14–16 lead to channels 14A–16A which extend upwards at 14B–16B and then horizontally at 14C–16C and merge into a single outlet passage 19. The bottom opening 17 leads by a separate channel 17A to the lower end of a vertical air passage 20, the upper end of which also leads to the outlet passage 19.

The air flow distribution is adjusted by the louvres so that the air is at a progressively higher speed towards the bottom of the compartment 10A, so that the top three openings 14–16, collect light laminae, and the opening 17 collects heavy stem or stem with laminae attached.

The vertical air passage 20 provides for a further removal of clean laminae i.e., without stem, which may be entrained by the stem.

The stem is conveyed from the compartment 10A to the vertical air passage 20 pneumatically, instead of by a conveyor band as in known apparatus.

The louvres nearest to the bottom of the compartment 10A are adjusted to give a high air velocity at the bottom surface (about double that of the velocity at the upper end of the compartment 10A), so that heavy stems, which tend to drop onto the surface are swept along into the bottom opening 17 and into the vertical air passages. The stem falls to the bottom of the vertical air passage and is removed by a compartmented wheel 21, which is divided by vanes 21A into a series of compartments 21B.

By providing three laminae collection side passages 14–16 a greater opportunity is provided for clean laminae to be separated and a higher separating efficiency to be achieved.

The threshing drum 13 and separating chamber 10 can typically be made from 30" (76 cm) to 60" (152 cm) wide and the chamber 48" (132 cm) high. The air must be uniformly distributed across the width of the chamber so air guides may be provided in the duct 12 between the fan 11 and chamber air inlet 9.

The system may use approximately 250 cubic feet per minute of air per inch of the width of the machine (2.78 cubic meters per minute per centimeter) and handles approximately 100 lbs. (224 kg) of tobacco leaf per inch of width. The air may be separated from the clean laminae and recirculated back to the fan inlet.

We claim:

1. A tobacco separator for separating tobacco laminae from mid-rib or stem matter of threshed tobacco, comprising the combination a separating chamber having top, bottom and side walls, an inlet in the top of said chamber for admitting downwardly into said chambers a mixture of tobacco laminae and stems, an air inlet in one side of the chamber for establishing an air flow across the chamber, a plurality of discharge openings arranged vertically one above the other in the side wall of the chamber opposite the air inlet for receiving respective portions of the air flow, the bottom of the lowermost one of said discharge openings being no higher than the level of the bottom of the separating chamber, means for creating a flow of air through the air inlet on one side wall of the chamber, horizontally across the chamber, and into said discharge openings on the opposite side wall of the chamber, said air flow extending from substantially the top to the bottom of the chamber and substantially completely across its dimension that is transverse to the air flow, means located as said air inlet for establishing a nonuniform speed distribution of air flow, in a vertical plane, through said separating chamber so that the substantially horizontally moving air has higher speeds at the bottom of the chamber than at the top of the chamber, said air speeds being proportioned so that stems fall to the bottom of the chamber and are swept out said lowermost discharge opening by the higher air speed at the bottom of the chamber and lighter laminae move transversely and pass through the remainder of said discharge openings where air speeds are lower, a vertically extending air passage connected to and receiving air only from said lowermost discharge opening for further separating laminae and stems that were swept into the lowermost discharge opening, a single outlet passage connected to said vertical extending air passage and to said remainder of the discharge openings for combining all the laminae separated from the stems into a single output air stream, and means at the bottom of the vertically extending air passage for removing stems swept into the lowermost discharge opening of the separation chamber.

2. The tobacco separator claimed in claim 1 that further includes, a respective discharge channel connecting each one of said remainder of the discharge openings with said output passage, each discharge channel including a vertically directed portion and a horizontally directed portion, said horizontally directed portions of the discharge channels merging into said single outlet passage.

3. The tobacco separator claimed in claim 1 including a tobacco thresher disposed on said inlet on the top of said separator chamber for discharging threshed tobacco directly into said separation chamber.

4. The tobacco separator claimed in claim 1 wherein said means for establishing a nonuniform distribution of air flow through the separating chamber includes means for establishing a speed of air flow at the bottom portion of the chamber that is about twice the speed of the air flow at the top portion of the chamber, whereby heavier stems fall to the bottom of the chamber and are swept into the lowermost discharge opening by the higher speed air while lighter laminae entering the chamber from the top are directed transversely into the remainder of the discharge openings.

5. The tobacco separator claimed in claim 4 wherein the bottom of the chamber is a substantially flat surface to facilitate sweeping of the stems into said lowermost discharge opening by said higher speed air flow across the bottom of the chamber.

* * * * *